US005787516A

United States Patent [19]

Davenport

[11] Patent Number: 5,787,516

[45] Date of Patent: Aug. 4, 1998

[54] MULTI-PURPOSE WATER PRESSURE PLUNGER

[76] Inventor: Clyde F. Davenport, P.O. Box 8127, Greenwood, S.C. 29649

[21] Appl. No.: 623,338

[22] Filed: Mar. 27, 1996

Related U.S. Application Data

[60] Division of Ser. No. 382,917, Feb. 3, 1995, Pat. No. 5,537,694, which is a continuation-in-part of Ser. No. 132,109, Oct. 5, 1993, abandoned, which is a continuation-in-part of Ser. No. 33,942, Feb. 16, 1993, Pat. No. 5,261,128, which is a continuation of Ser. No. 799,351, Nov. 27, 1991, abandoned, which is a continuation-in-part of Ser. No. 498,287, Mar. 23, 1990, Pat. No. 5,020,166.

[51] Int. Cl.[6] ..... E03D 9/00

[52] U.S. Cl. ..... 4/255.04

[58] Field of Search ..... 4/255.01–255.11

[56] References Cited

U.S. PATENT DOCUMENTS

| | | | |
|---|---|---|---|
| 1,745,923 | 2/1930 | Frizell | 4/255.03 |
| 1,758,541 | 5/1930 | Simon | 4/255.09 |
| 1,804,874 | 5/1931 | Hrinas | 4/255.08 |
| 1,836,202 | 12/1931 | Teigaler | 4/255.11 |
| 2,039,792 | 5/1936 | Harder | 4/255.08 |
| 2,055,801 | 9/1936 | Perry | 4/255.08 |
| 2,072,555 | 3/1937 | Hengesbach et al. | |
| 2,126,689 | 8/1938 | Pouliot | |
| 2,267,064 | 12/1941 | Wikelund | |
| 2,670,475 | 3/1954 | Hord | 4/255.05 |
| 2,736,906 | 3/1956 | Ramseur | |
| 3,023,428 | 3/1962 | Otteson | 4/255.04 |
| 3,315,280 | 4/1967 | Krenn | 4/255.01 |
| 3,537,113 | 11/1970 | Elzner | |
| 3,632,046 | 1/1972 | Hengesbach | |
| 3,756,273 | 9/1973 | Hengesbach | |
| 4,238,860 | 12/1980 | Dixon | |
| 4,320,539 | 3/1982 | Steven | |
| 4,622,702 | 11/1986 | Allen | |
| 4,674,137 | 6/1987 | Girse | |
| 4,768,237 | 9/1988 | Torti | |

FOREIGN PATENT DOCUMENTS

| | | | |
|---|---|---|---|
| 0085017 | 3/1937 | Sweden | 4/255.04 |

*Primary Examiner*—Charles E. Phillips
*Attorney, Agent, or Firm*—Hardaway Law Firm, P.A.

[57] ABSTRACT

A multi-purpose water pressure plunger is provided having a compressible cup defining an interior cavity and having a solid rubber upper portion with a top and a bottom. The cup has an outer wall which extends to form a barrel-like bottom with edges for partially extending into and sealing against walls of a drain opening. The upper portion of the compressible cup has a central passage defined therethrough beginning in a first opening at the top of the upper portion and terminating in a second opening at the bottom of the upper portion. An elongated handle is attached to the top of the upper portion and has a lengthwise aperture therethrough. The water pressure plunger includes a rubber member with a central passage removably and interchangeably attachable to the bottom of the upper portion inside the interior cavity of the compressible cup and to the handle or a valve thereon. The central passage of the rubber member terminates in a nipple-shaped end for fitting into and sealing against a drain opening. A hand-held water pressure plunger is also disclosed which utilizes the removable rubber member and includes a handle portion having a first passage therethrough communicating with a second passage which extends into the rubber member.

10 Claims, 10 Drawing Sheets

MULTI-PURPOSE WATER PRESSURE PLUNGER

CROSS REFERENCE TO RELATED APPLICATIONS

This application is a division of application Ser. No. 08/382,917, filed Feb. 3, 1995, now U.S. Pat. No. 5,537,694, which is a continuation in part of application Ser. No. 08/132,109, filed Oct. 5, 1993, now abandoned, which is a continuation in part of Ser. No. 08/033,942, filed Feb. 16, 1993 and now U.S. Pat. No. 5,261,128, which is a continuation of Ser. No. 07/799,351, now abandoned filed Nov. 27, 1991, which is a continuation in part of Ser. No. 07/498,287 filed Mar. 23, 1990 and now is U.S. Pat. No. 5,020,166.

BACKGROUND OF THE INVENTION

This invention relates generally to the art of drain clearing devices, and more particularly, to drain clearing devices which utilize pressurized water to eliminate drainage obstructions which occur in bathroom pipes and the like.

The art of unclogging drainage pipes is well known and has conventionally employed manually-operated devices of the type comprising a resiliently collapsible, rounded cup having an open interior cavity. Attached to the cup is an elongated handle element extending from the end thereof opposite the open interior cavity. The cup is placed over a drainage entrance, and by applying a downward and upward force to the handle, the cup is alternately compressed and expanded. The suction caused by this motion is somewhat effective in loosening small drainage clogs, however, larger obstructions may not be budged by such manual devices. One such device is disclosed in U.S. Pat. No. 4,622,702 to Allen wherein a manually operated plunger includes a collapsible cup for covering and sealing around a drain opening.

U.S. Pat. No. 4,674,137 to Girse discloses an electrically operated cup attached to a manually operated pumping member.

The art of clearing drainage pipes has also employed pressurized water for forcing a clog from its lodged position into the sewer system. These pressurized devices are of the type comprising a resilient drain sealing member of differing shapes and sizes. An elongated handle, having a lengthwise passage therethrough, communicates with the sealing member and extends from the end thereof opposite the sealing member. A flow of pressurized water passes into and through the handle consequently entering the drain which is proportionately embraced by the sealing member.

One such device is disclosed in U.S. Pat. No. 3,537,113 to Elzner wherein a collapsible cup of the conventional type covers and seals around the opening of a drain. A flow of pressurized water, controlled by a faucet-type valve, passes through the handle and into the drain.

U.S. Pat. No. 4,768,237 to Torti discloses a tubular handle element attached to a mushroom-shaped cup having a check valve to prevent a backflow of water. A female means on the opposite end of the handle allows the connection to a pressurized source of water.

U.S. Pat. No. 4,320,539 to Li discloses an elongated pipe with a manually operated plunger valve which activates a flow of pressurized water. A side arm, branching from and communicating with the pipe, is attached to a source of pressurized water by a male means of connection.

Other prior art devices that teach utilizing water pressure to clear clogged drains include U.S. Pat. No. 2,267,064 to Wikelund, U.S. Pat. No. 2,736,906 to Ramseur, U.S. Pat. No. 3,023,428 to Otteson, U.S. Pat. No. 4,238,860 to Dixon, and U.S. Pat. No. 2,039,792 to Harder.

While the above prior art devices may perform satisfactorily in many instances, they are often incapable of providing a sanitary and efficient means of unclogging bathroom drains and the like. In particular, the drain clearing devices of the prior art are not constructed to allow for a secure enough seal of a drain opening, they do not permit the correct thrust of pressurized water to a clog, and they do not afford themselves to easy operation by the ultimate consumer. Furthermore, many of the prior art devices require the use of two hands to best utilize the devices, and accordingly, there exists room for improvement for a drain clearing device which provides for ease of use and can be utilized with one hand when desired.

OBJECTS OF THE INVENTION

It is an object of this invention to provide a multi-purpose water pressure plunger and process of using the same which is safe, easy to use and which connects to a standard source of pressurized water.

It is a further object of this invention to provide a multi-purpose water pressure plunger which can completely seal various drain openings and which generates a direct impact of pressurized water to a drainage clog.

It is a still further object of this invention to provide a multi-purpose water pressure plunger which provides for interchangeable, removable attachments for varying uses and sealing against smaller drain openings.

It is a still further object of this invention to provide a multi-purpose, hand-held water pressure plunger.

These, as well as other objects, are accomplished by providing a water pressure plunger comprising: a plunger portion comprising: an upper portion, the upper portion having a passage therethrough and an outer circumference; a compressible cup portion attached to a bottom of the upper portion, the compressible cup portion defining a cavity having an orifice; and a hollow handle attached to the plunger, the hollow handle being in fluid communication with the cavity because of the central passage in the upper portion.

DETAILED DESCRIPTION OF THE DRAWINGS

Figure 1A:
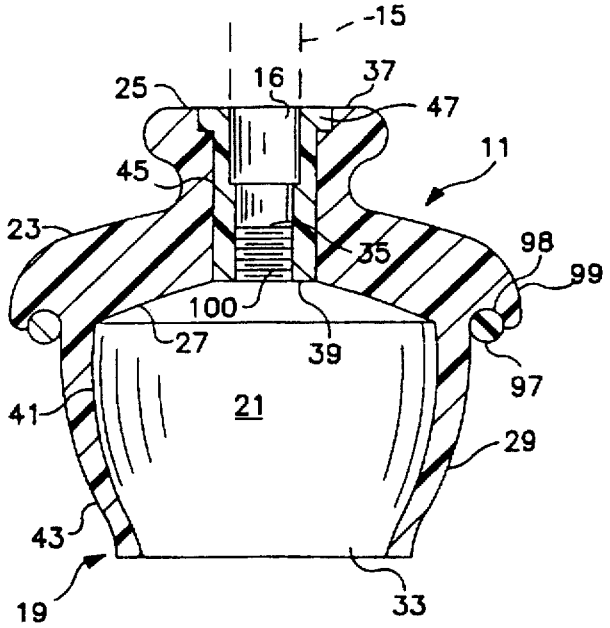
FIGS. 1A–C are sectional views of a first embodiment of the water pressure plunger according to the invention.

FIG. 1A is a sectional view of a first embodiment of a water pressure plunger according to this invention. Plunger 11 comprises a compressible cup 19 defining an interior cavity 21 therein attached to a solid rubber upper portion 23 having a top 25 and a bottom 27. Typically, cup 19 and upper portion 23 will be attached to each other by forming them as a unitary structure. Because upper portion 23 has a circumference greater than that of cup 19, a lip 99 is formed by ridge 98, which encircles the compressible cup 19, and optionally contains an O-ring 97. Compressible cup 19 has a side wall 29 which extends from its maximum circumference in the area 41 of the upper portion 23 and tapers to a smaller circumference at bottom portion 43 in the area of a circumferential orifice 33.

Figure 1B:
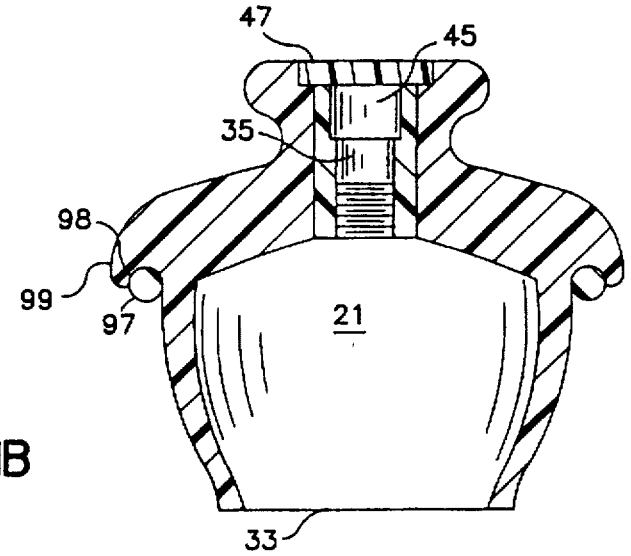

Solid upper portion 23 has a central passage 35 defined therethrough. Central passage 35 begins in a wide first opening and recess 37 (hereinafter "recess") in top 25 of upper portion 23 and terminates in a narrower second opening 39 positioned centrally at bottom 27 of upper portion 23. Insert 45, having a central passage 16 coaxial with central passage 35, is inserted within central passage 35. Insert 45 may be metal (FIG. 1A) or plastic (FIG. 1B). Circular pressure disc 47 is attached to insert 45 and recessively and tightly held within recess 37 of upper portion 23. Pressure disk 47 is constructed of a material having a rigidity greater than that of rubber upper portion 23. Furthermore, pressure disk 47 has a hole therethrough coaxial with central passage 35 and having the same diameter as central passage 16 and handle 15. Handle 15 is elongated and hollow and inserted through both top 25 of upper portion 23 and insert 45, centrally through disc 47 and maintained therein by a pressure and/or friction fit.

Figure 1C:
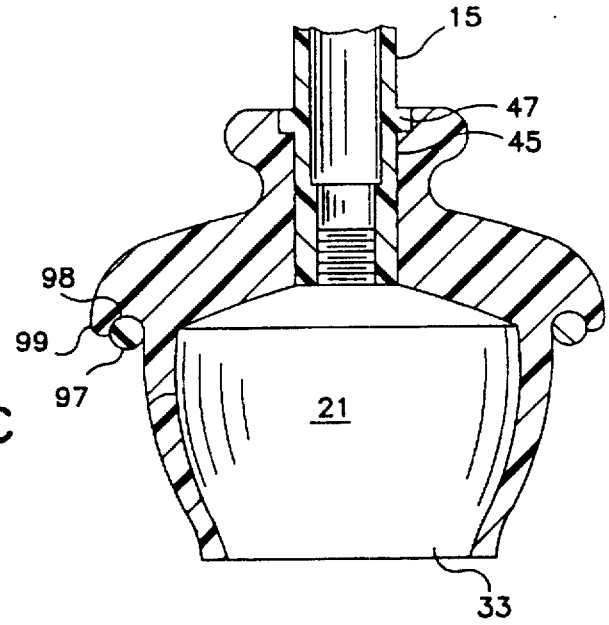

In FIGS. 1A and 1B, disc 47 is shown to be integral and preferably unitary with insert 45, but separate from handle 15, and engaging handle 15 as it passes through disc 47 to provide stability and support for the handle. However, as illustrated in FIG. 1C, disc 47, insert 45, and handle 15, may have an integral or unitary construction. This integral or unitary construction further enhances the ability of handle 15 to manipulate the plunger for effectively sealing against a drain opening.

Figure 2:
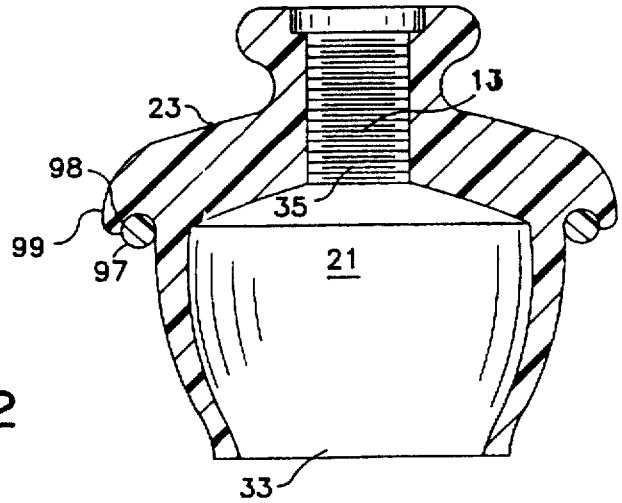
FIG. 2 is a sectional view of a second embodiment of the water pressure plunger according to the invention.

FIG. 2 shows a second embodiment that omits insert 45. In this embodiment, central passage 35 contains threads 13 that would engage similar threads on handle 15.

The hollow nature of the plungers and the handles of the embodiments of FIGS. 1–2 makes it easy to utilize a pressurized water source, whose flow is controlled by a valve, to pass into and clear a drain. The source of pressurized water may be, for example, any of those to be described herein or in any of my related applications. Furthermore, in each of these embodiments, the lowermost portions of either insert 45 or recess 37 has, as will be described below, a connection thereon for attaching an optional second member or hose to further assist in clearing the drain opening.

When clearing drain openings, bottom portion 43 will fit into small and large drain openings, and lip 99 forms a seal around the opening as cup 19 is compressed. O-ring 97 may be attached to form an even better seal. A flow of water will then be passed through insert 45 (FIGS. 1A–C) or central passage 35 (FIG. 2) and into the drain and act to dislodge and clear any clogs. Note that is also possible to provide, in place of handle 15, a hose, such as a garden hose, which may be directly inserted through disc 47 and into insert 45.

Figure 3:
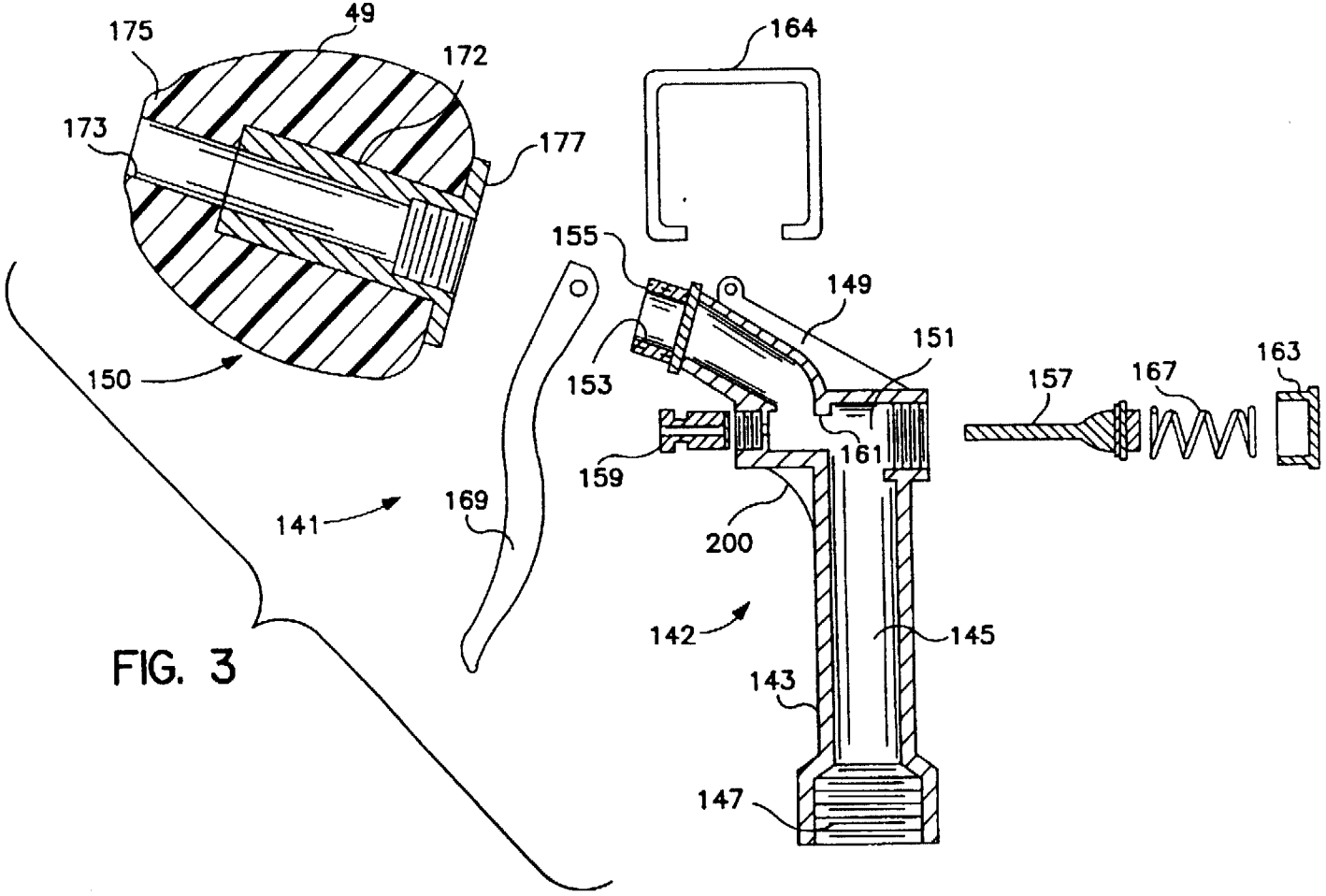
FIG. 3 is a side view of a third embodiment of the water pressure plunger according to this invention.

FIG. 3 shows a third embodiment of the water plunger according to the invention. FIG. 3 shows a sectional view of a hand-held water pressure plunger 141 in accordance with this invention. Plunger 141 comprises a trigger valve assembly 142 and a plunger assembly 150. Plunger 141 may be hung on a wall by hanger 164.

Valve assembly 142 is similar to those found in U.S. Pat. Nos. 2,072,555; 3,632,046; and 3,756,273; all of which are incorporated by reference herein. Valve assembly 142 comprises handle portion 143 having first passage 145 defined therethrough and coupling 147 for connection to a pressurized water source. Main portion 149 is illustrated as connecting with handle portion 143 and being in fluid communication therewith, because of intermediate portion 200. Main portion 149 has second passage 153 defined therethrough which is in communication with first passage 145 because of intermediate passage 151. Second passage 153 terminates in a circumferential orifice 155, having a coupling member and optional washer, thereon. Pressure valve stem 157 is positioned within intermediate passage 153 for movement therein. An adjustable valve stem guide nut 159 is located at one end of intermediate passage 153 while the other end has an assembly cap 163 attached thereto. Finally, spring 167 is used to bias valve stem 157 in the closed position against valve seat 161.

Valve assembly 142 includes a lever or trigger 169 pivotally attached to the exterior portion of plunger 141 and positioned to abut an end of valve stem 157 protruding from adjustable valve stem guide nut 159 so that lever 169 can be pivotally moved to cause the valve stem to move away its seat 161. The amount of pivotal movement available to trigger 169 is controlled by adjustable guide nut 159. This trigger movement controls the flow of pressurized water through the first passage, the intermediate passage, and the second passage.

While the above-described hand-held trigger valve assembly 125 is preferred because of its improved flow characteristics, the use of other types of valves are still contemplated and within the scope of the invention.

Plunger assembly 150 comprises a bullet-shaped rubber member 49 having central passage 173 defined therethrough that terminates in nipple-shaped end 175. Nipple-shaped end 175 allows rubber member 49 to more flexibly seal against a drain opening. It is envisioned that rubber member 49 for attachment to hand-held plunger 141 can be similar or identical to rubber members 49' used in my other disclosed embodiments. Rubber member 49 has insert 172 inside central passage 173 for connection to or unitary construction with pressure disk 177 constructed from a material having a rigidity greater than that of rubber member 49. Pressure disk 177 provides added support and stability to rubber member 49 when hand-held plunger 141 is sealing against and clearing a drain opening.

Rubber member 49 is illustrated as bullet-shaped with a nipple-shaped end. However, it has been found that a rounded, smooth end in place of the nipple-shaped end also works well. Though rubber member 49 should be removable, rubber member 49 may be fixedly secured to hand-held plunger 141. Furthermore, in FIG. 3, rubber member 49 is not shown as including vent grooves, as shown in some of my other applications. This is because there is no need for inclusion of vent grooves for a rubber member 49 attached to this hand-held plunger 141 since there is no compressible cup surrounding the rubber member. However, inclusion of vent grooves on rubber member 49 should have little or no effect on the performance of hand-held plunger 141.

Figure 4A:
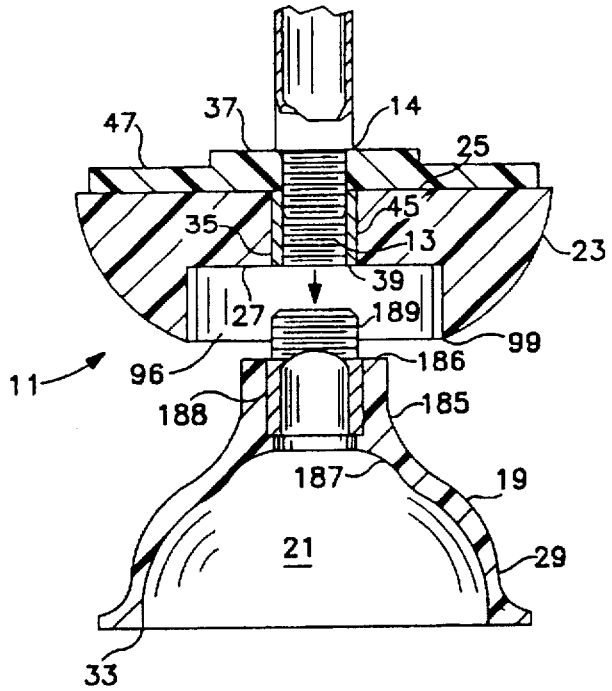
FIGS. 4A–C are sectional views of a water pressure plunger having interchangeable heads according to a fourth embodiment of the invention.
Figure 4B:
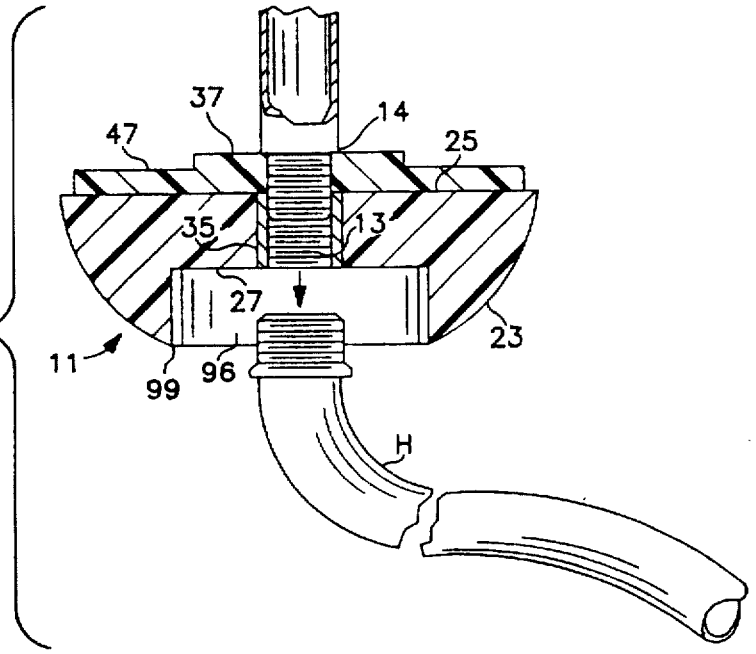
Figure 4C:
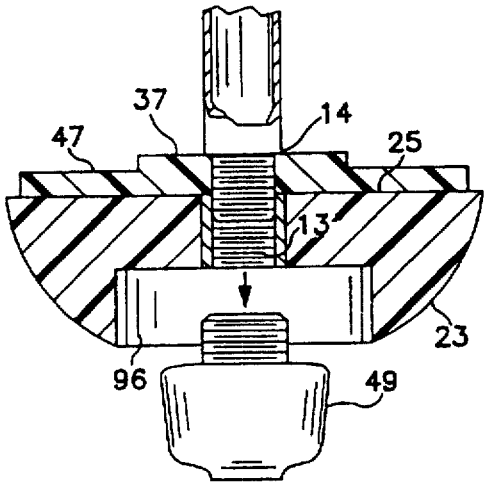

FIGS. 4A–C illustrate a fourth embodiment of the plunger according to the invention. In this embodiment, plunger 11 comprises a two or three part structure, an upper plunger part 11 and a lower interchangeable part for various applications. The optimal third part is optional pressure disk 37.

For example, in FIG. 4A plunger 11 comprises a solid rubber upper portion 23 with a top 25 and a bottom 27 and a second part, in the form of a compressible cup 19 defining an interior cavity 21. Bottom 27 of upper portion 23 has a circular shape in the area of a cut out portion 96 forming lip 99. Upper portion 23 has a central passage 35 defined therethrough having threads 13 formed either on the walls of the passage 35 or on an insert 45 fitted into passage 35. The threads may be either male or female.

The optional pressure disk 37 of this embodiment is similar to that of FIG. 1 and 2 in that it has a hole therethrough, in this case threaded, and made from a material having a rigidity greater than that of the upper portion 23. In this embodiment, pressure disk 37 is shown as having an outer perimeter 47 extending outward almost to the point of covering the entire top 25 of upper portion 23. This provides for maximum assistance in manipulating plunger 11. This disk design is equally applicable to all other embodiments. Pressure disk 37 may be recessively held as described above, or sandwiched between top 25 of upper portion 23 and lip 14 of handle 15.

In FIG. 4A, as described above, the second part comprises compressible cup 19. Compressible cup 19 has an upper part 185 with a top 186 and a bottom 187 and a side wall 29 which extends from the upper part 185 and flares outwardly like a bell to define a circumferential orifice 33. Upper part 185 of compressible cup 19 has a central passage 188 containing threaded insert 189. The threads may be either male or female threads depending upon the type of threads found on insert 35 of upper portion 23.

In operation, the upper portion 23 alone may be used to seal a drain opening by fitting into it. In use, lips 99 will bend inwardly into the drain opening. Alternatively, cup 19 may be attached by mating the opposing threads in the bottom 27 of the upper portion 23 with those of threaded insert 189. In this configuration, side wall 29 of cup 19 surrounds the drain opening. When used this way, the lips 99 support and reinforce side wall 29 as it bends back.

In FIG. 4B, cup 19 is replaced by a short piece of hose H. This piece of hose H is directed as deep into the drain as possible while upper portion 23 and lip 99 form an effective seal at the drain opening. With this embodiment it is attempted, by directing the hose down the drain, to apply the maximum possible water pressure in the immediate vicinity of the clog.

In FIG. 4C, both cup 19 and short piece of hose H are replaced with a bullet-shaped rubber member 49 preferably identical to that of FIG. 3 and described with reference to FIG. 3 above. Although in FIG. 4C bullet-shaped rubber member 49 is shown with a male connection, it may have either a male or a female connection depending upon what type of connection upper portion 23 has, and a conventional two-way adapter (not shown) may be used to change a male connection to a female connection and vice-versa. As shown in FIG. 4C, bullet-shaped rubber member 49 is smaller, in radial extent, than cut-out portion 96. Due to the difference in size between bullet-shaped rubber member 49 and cut-out portion 96, a gap is formed therebetween.

Figure 5A:
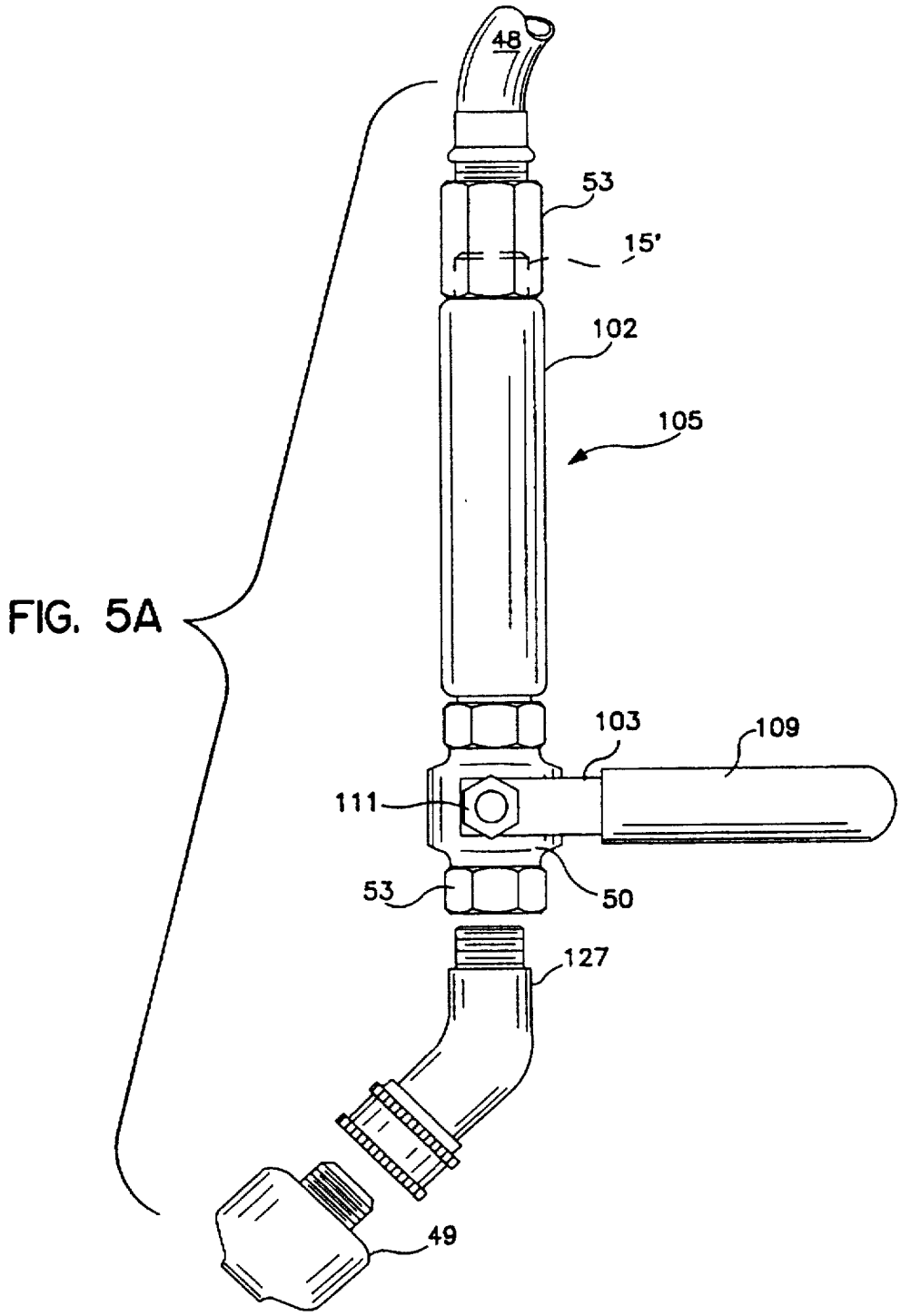
FIGS. 5A–E are side views of a fifth embodiment of the water pressure plunger according to the invention.
Figure 5B:
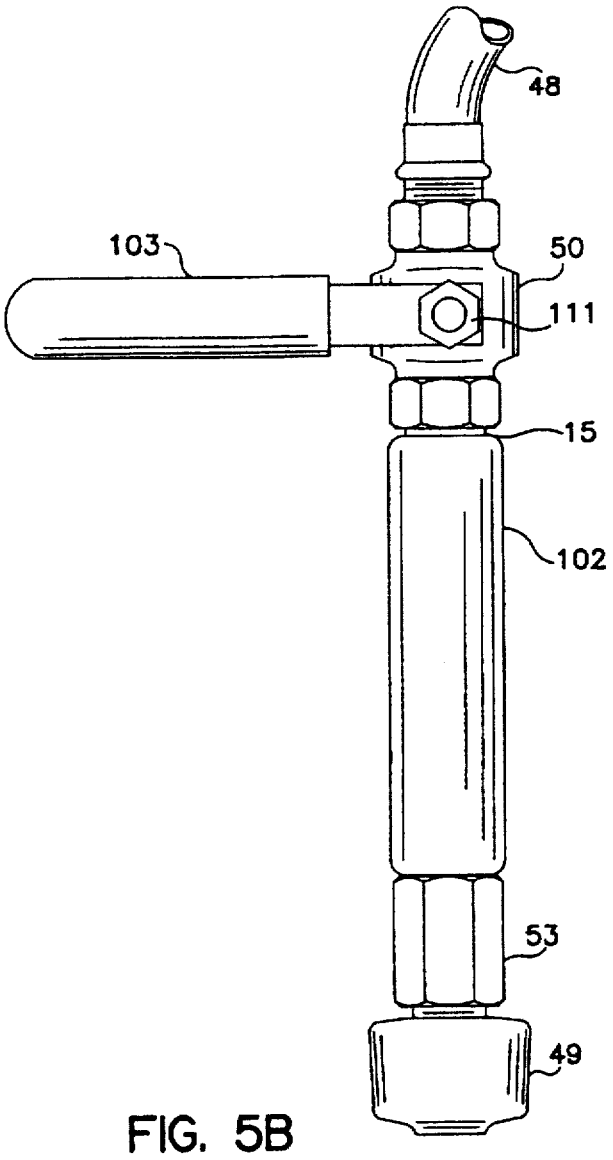
Figure 5C:
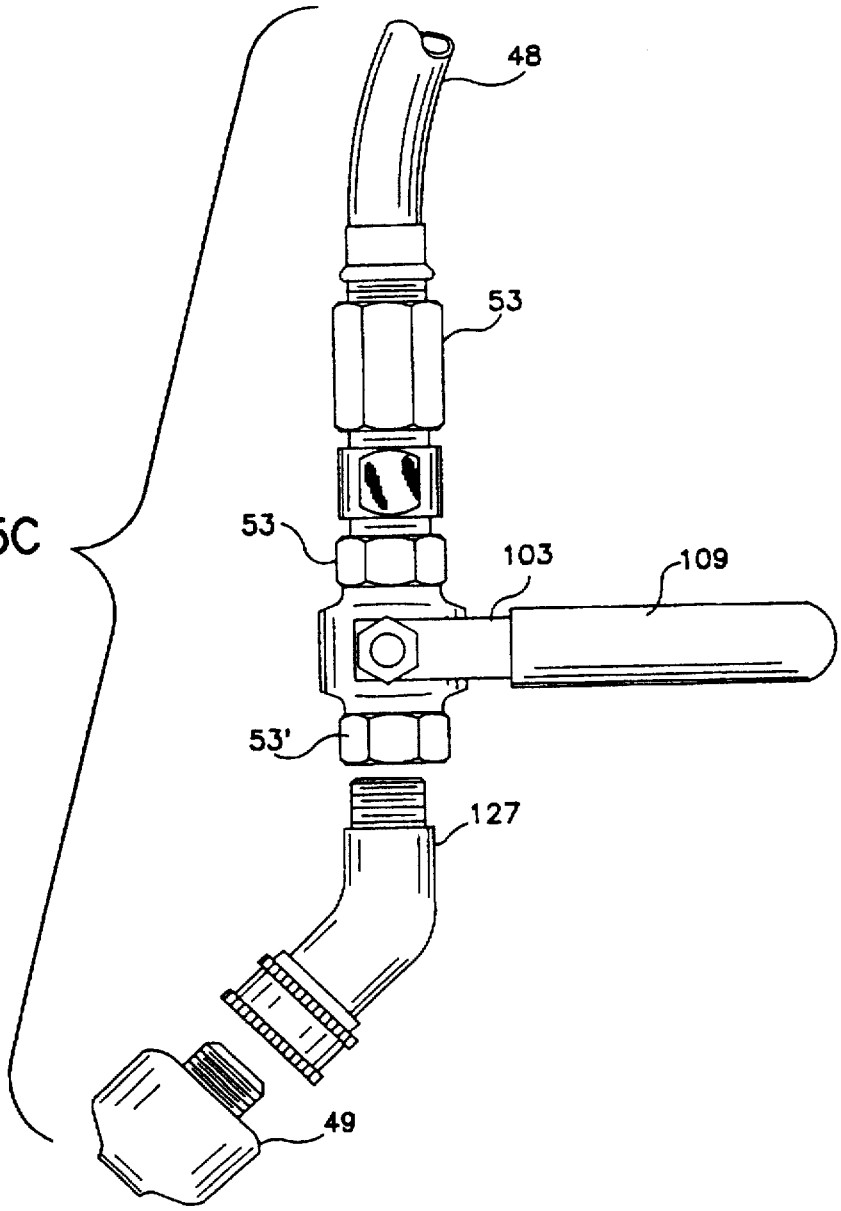

In FIGS. 5A–C, a fifth embodiment of the invention is shown. In this embodiment, adjustable valve 50 is connected to an end of elongated and hollow handle 15' encased in insulating material 102. Valve 50 could alternatively be interposed anywhere along the length of the handle between a water source and a drain attachment. While the drain attachment may come in the form of any of the rubber plunger shapes described herein, it is especially preferred for it to be the same as rubber member 49 described in reference to FIG. 3. Adjustable valve 50 is fashioned from leak-proof and non-corrosive materials which have suitable coatings, platings, and flow characteristics for the intended application. A regulating lever 109, also encased in an insulating material 103, controls a not-shown ball component inside the valve which governs the flow of water from pressurized source 48 through the hollow handle. Regulating lever 109, attached to valve 50 by a threaded screw nut 111, prohibits a flow of water when it is moved perpendicular to the elongated handle 15'. Regulating lever 109 is moved downward from its "off" position to start a flow of water. Full flow of pressurized water occurs when the regulating lever 109 becomes parallel to the elongated handle 15'.

In a first mode of operation, as shown in FIG. 5A, a pressurized source of water such as hose 48 is connected to the valve having a connector 53 in the form of, e.g., screw threads. Connector 53 should be the same as connector 53' at the other end of handle 15' so rubber member 49 and the source of water can be interchangeably attached to either end of the handle 15' for alternative uses. For example, in FIG. 5A rubber member 49 is positioned at the end of the handle 15' on the side of valve 50 away from handle 15'. In FIG. 5B, rubber member 49 is positioned at the end of the handle 15 on the side of valve 50 closer to handle 15'. To operate either configuration of this embodiment, the rubber member/handle combination, in either of its configurations, is fitted against a drain opening to seal the drain opening and the regulating lever 109 is moved to allow the flow of water through the elongated and hollow handle 15'. The tight seal of rubber member 49 prevents a backflow of water and regulating lever 109 permits the appropriate flow of water to reach and act to dislodge the clog.

Optional elbow joint 127 bends approximately 45° and is particularly advantageous for reaching, sealing against, and clearing, small drains in hard-to-reach places such as washing machine drains typically found in the wall behind the washing machine. Like rubber member 49, elbow 127 will be capable of attachment to either end of handle 15'.

In the variation on this embodiment shown in FIG. 5C, handle 15' is omitted and both rubber member 49 and hose 48 are directly attached to valve 50, except for the optional interposition of the elbow 127, if needed. As usual, when rubber member 49 is positioned in a sealing configuration within the drain, valve 50 is turned on to release pressurized water to clear the drain.

Figure 5D:
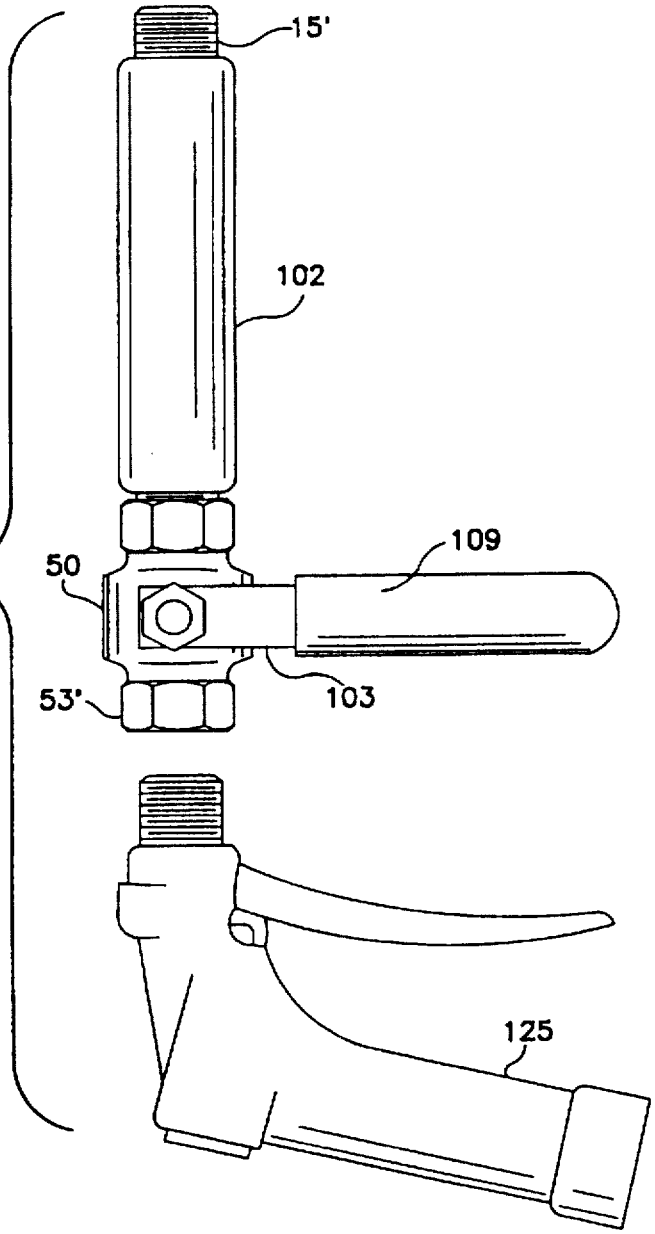
Figure 5E:
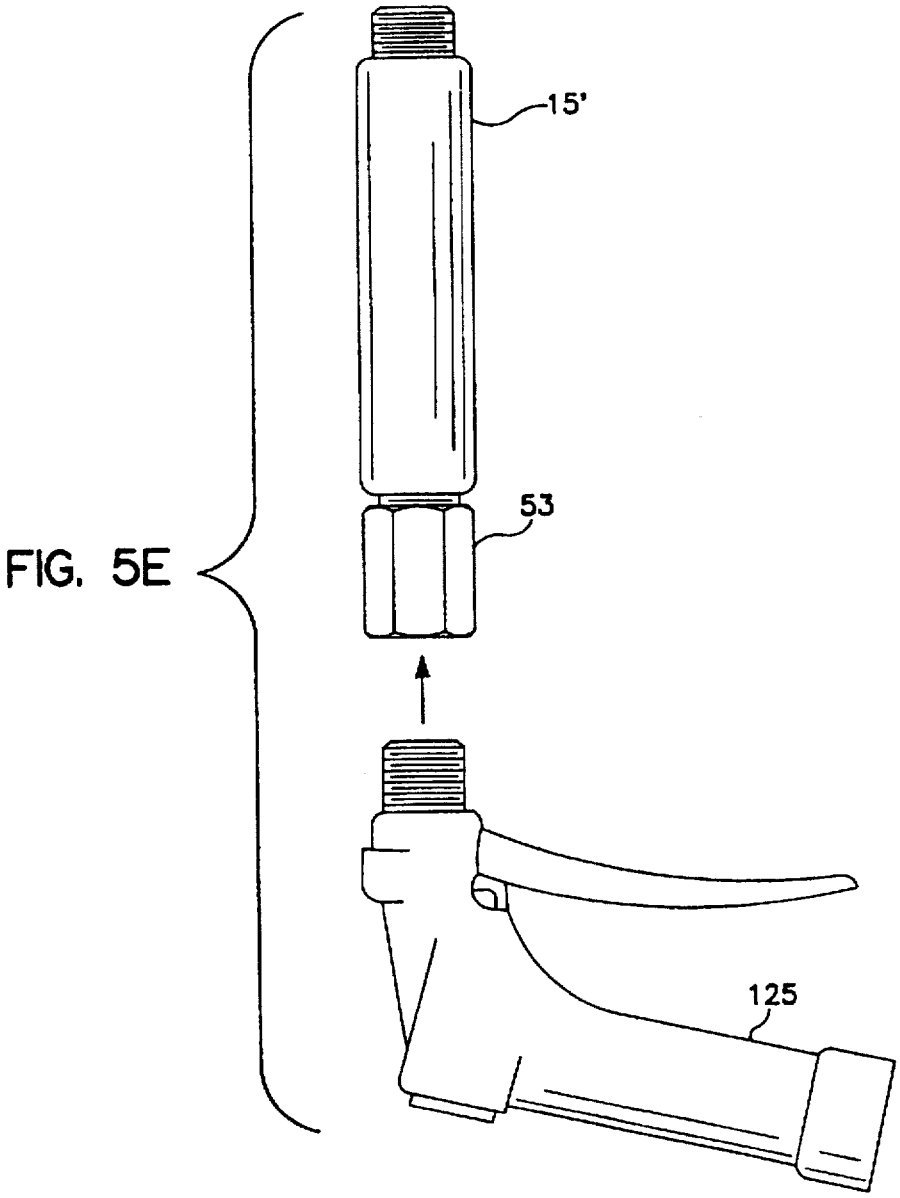

FIGS. 5D–E show yet two more configurations of this embodiment. In these configurations water hose 48 is replaced with conventional hand-held valve assembly 125, similar to or identical with that shown in FIG. 3. Valve assembly 125 will have, for example, screw threads thereon, connected to connector 53 of valve 50. In FIG. 5D, valve assembly 50 is connected to handle 15' in the area of valve 50. In FIG. 5E, valve assembly 125 is connected to handle 15' at the end opposite of valve 50. By using hand-held valve assembly 125 in this manner, both valve 50 and valve assembly 125 can be used to control the flow of pressurized water through the plunger. Valve 50 can be opened and hand-held valve assembly 125 used to control the flow of water or valve assembly 125 can be fixed in the open position to allow flow therethrough while valve 50 is used to control flow through rubber member 49. This hand-held embodiment requires only the use of one hand and is quite effective for sealing against and clearing small drains.

It is therefore seen that the present invention provides a multi-purpose water pressure plunger and process of using the same which is safe, easy to use and which connects to a standard source of pressurized water.

It is also seen that the present invention provides a multi-purpose water pressure plunger with components that are interchangeable for sealing and clearing various drain openings.

It is further seen that the present invention provides a multi-purpose water pressure plunger which provides a removable attachment for sealing against smaller drain openings.

It is further seen that the present invention provides a multi-purpose, hand-held water pressure plunger and process of using the same which can also utilize a standard source of pressurized water to clear clogged drains.

As various modifications will become apparent to those of skill in the art from a reading of the above description, such modifications are embodied within the spirit and scope of this invention as measured by following the appended claims.

That which is claimed is:

1. A water pressure plunger comprising:

an upper portion, said upper portion having a cut-out portion having a generally annular periphery forming a lower lip at its intersection with a surface of said upper portion, said lower lip capable of insertion into a drain; and a hollow passage extending entirely through said upper portion and in communication with said cut-out portion;

a hollow handle, said handle having a first end, whereby said first end of said handle and said upper portion are joined together to form an integral unit; and a plurality of lower portions, each said lower portion being smaller in radial extent than said lower lip for insertion into smaller drains, each said lower portion capable of being removably joined to said integral unit within said cut-out portion, and having a hollow passage therethrough coaxial with the hollow passage in said integral unit; each of said plurality of said lower portions having a shape different than the other of said plurality of lower portions for use in different drain configurations;

whereby a gap exists between said lower portion and said generally annular periphery of said integral unit.

2. The water pressure plunger according to claim 1, further comprising a pressure disk having a hollow passage therethrough coaxial with the hollow passage of said upper portion;

wherein said handle includes a lip; and said pressure disc is positioned between a top surface of said upper portion and said lip of said handle.

3. The water pressure plunger according to claim 2, wherein said handle, said upper part, and said pressure disk are joined together by use of threads in said hollow passage of said upper portion and matching threads on said first end of said handle.

4. The water plunger according to claim 3, wherein said lower portion is removeably joined to said integral unit by use of matching threads in said hollow passage of said upper portion and on said lower portion.

5. The water pressure plunger according to claim 1, wherein said lower portion comprises a rubber member.

6. The water pressure plunger according to claim 1, wherein a source of water is connected to an opposite end of said handle to allow pressurized water to flow through said handle, pressure disk, upper portion, and lower portion, and then into said drain.

7. The water pressure plunger according to claim 2, wherein said pressure disk has a rigidity greater than that of said upper portion.

8. The water pressure plunger as recited in claim 1, wherein one of said plurality of lower portions comprises a hollow hose.

9. The water pressure plunger as recited in claim 1, wherein one of said plurality of lower portions comprises a compressible cup.

10. A water pressure plunger comprising:

a round, solid rubber upper portion comprising:

a flat, top surface having a diameter;

a bottom surface;

a rounded, outer peripheral surface extending between said top and bottom surfaces;

a circular cutout in said bottom surface having a diameter, and comprising:

a round outer wall; and a flat bottom portion positioned away from said bottom surface, wherein said wall and said bottom surface form a lip therebetween;

a passage extending between said top surface and said bottom portion of said cutout, said passage having threads therein;

an annular pressure disc secured to said top surface of said upper portion, said pressure disc extending radially outward from said passage of said upper portion, and having a diameter less than said diameter of said top surface;

a handle secured to said pressure disc to form an integral unit with said pressure disc and said upper portion, said handle having a hollow interior in communication with said passage of said upper portion; and a rubber lower portion removably secured to said upper portion and comprising:

an upper surface positioned adjacent said bottom portion of said cutout;

a lower surface;

a rounded, outer peripheral surface extending between said upper and lower surfaces of said lower portion;

a passage extending between said upper and lower surfaces;

a connector extending from said upper surface of said lower portion and comprising:

an exterior surface having threads thereon complementary to said threads in said passage of said upper portion;

a hollow interior in communication with said passage in said upper portion;

wherein said lower portion has a diameter less than said diameter of said cutout so that at least a part of said lower portion is positioned within said cutout to form a gap between said peripheral surface of said lower portion and said wall of said cutout.

* * * * *